US008893446B2

(12) United States Patent
Mathijssen et al.

(10) Patent No.: US 8,893,446 B2
(45) Date of Patent: Nov. 25, 2014

(54) SYSTEM PROVIDED WITH PANELS, AND METHOD

(75) Inventors: Markus Johannes Hendrikus Mathijssen, Nijmegen (NL); Ronald Theodoor Jan Volmeyer, Elst (Gld) (NL)

(73) Assignee: Remko Mark B.V., ME Herveld (NL)

( * ) Notice: Subject to any disclaimer, the term of this patent is extended or adjusted under 35 U.S.C. 154(b) by 55 days.

(21) Appl. No.: 13/001,966

(22) PCT Filed: Jul. 3, 2009

(86) PCT No.: PCT/NL2009/050396

§ 371 (c)(1),
(2), (4) Date: Mar. 9, 2011

(87) PCT Pub. No.: WO2010/002258

PCT Pub. Date: Jan. 7, 2010

(65) Prior Publication Data

US 2011/0268898 A1 Nov. 3, 2011

(30) Foreign Application Priority Data

Jul. 3, 2008 (NL) ..... 2001750

(51) Int. Cl.
*E06B 1/04* (2006.01)
*E06B 3/66* (2006.01)

(Continued)

(52) U.S. Cl.
CPC ..... *E06B 3/68* (2013.01); *E06B 3/2634* (2013.01); *E06B 3/6617* (2013.01); *E06B 7/14* (2013.01); *E06B 2003/26389* (2013.01); *E06B 2003/26309* (2013.01); *E06B 2003/26312* (2013.01); *E06B 1/18* (2013.01); *E06B 3/12* (2013.01); *E06B 1/325* (2013.01); *E06B 1/366* (2013.01); *E06B 1/36* (2013.01); *E06B 1/524* (2013.01)
USPC ..... 52/213; 52/204.1; 52/656.5; 52/656.6

(58) Field of Classification Search
USPC ..... 52/204.1, 208, 212, 213, 235, 656.5, 52/656.6
See application file for complete search history.

(56) References Cited

U.S. PATENT DOCUMENTS 3,844,087 A * 10/1974 Schultz et al. ..... 52/200
3,940,897 A * 3/1976 Stoakes ..... 52/395

(Continued)

FOREIGN PATENT DOCUMENTS

CH 6711999 10/1989
DE 85 32 985 4/1986

(Continued)

OTHER PUBLICATIONS

Blancquaert, Katleen, "International Search Report", International Application No. PCT/NL2009/050396, mailed on Sep. 30, 2009 (3 pages).

*Primary Examiner* — Brian Glessner
*Assistant Examiner* — Joshua Ihezie
(74) *Attorney, Agent, or Firm* — Fish & Richardson P.C.

(57) ABSTRACT

A system provided with panels, for instance glass sheets, and with elements (1, 2) which extend along edges of the panels, comprising: —at least a first element (1) which extends along a first edge of at least one panel (P), wherein the first element (1) is manufactured from metal, and is of solid design; —at least a second element (2) which extends along a second edge of the at least one panel (P), and —a connection (3, 4) between said first and second element (1, 2) which connection comprises at least a solid metal, preferably steel connecting element (3), wherein said connection is also provided with a thermally insulating part (4), wherein the thermally insulating part (4) is preferably substantially located in a space located opposite an end face of the panel (P).

27 Claims, 7 Drawing Sheets

(51) Int. Cl.

| | |
|---|---|
| ***E06B 3/68*** | (2006.01) |
| ***E06B 1/18*** | (2006.01) |
| ***E06B 3/12*** | (2006.01) |
| ***E06B 1/32*** | (2006.01) |
| ***E06B 1/36*** | (2006.01) |
| ***E06B 1/52*** | (2006.01) |
| *E06B 3/263* | (2006.01) |
| *E06B 7/14* | (2006.01) |

(56) References Cited

U.S. PATENT DOCUMENTS

| | | | | | |
|---|---|---|---|---|---|
| 4,251,964 | A | * | 2/1981 | Francis | 52/204.593 |
| 4,462,390 | A | * | 7/1984 | Holdridge et al. | 126/587 |
| 4,621,472 | A | * | 11/1986 | Kloke | 52/204.591 |
| 4,658,559 | A | * | 4/1987 | Doherty | 52/463 |
| 4,680,905 | A | * | 7/1987 | Rockar | 52/200 |
| 4,756,131 | A | * | 7/1988 | Stoakes | 52/171.3 |
| 4,765,102 | A | * | 8/1988 | Kuchem | 52/28 |
| 4,782,636 | A | * | 11/1988 | Stoakes | 52/235 |
| 4,848,053 | A | * | 7/1989 | Clausen | 52/204.591 |
| 4,903,454 | A | * | 2/1990 | Rose | 52/489.1 |
| 4,912,898 | A | * | 4/1990 | Holmes | 52/235 |
| 4,977,716 | A | * | 12/1990 | Hawkins | 52/235 |
| 5,018,326 | A | * | 5/1991 | Reynolds | 52/235 |
| 5,166,497 | A | * | 11/1992 | Meyer et al. | 219/213 |
| 5,199,236 | A | * | 4/1993 | Allen | 52/235 |
| 5,235,790 | A | * | 8/1993 | Ishikawa et al. | 52/235 |
| 5,309,689 | A | * | 5/1994 | Croissant | 52/235 |
| 5,333,428 | A | * | 8/1994 | Taylor et al. | 52/308 |
| 5,568,707 | A | * | 10/1996 | Ishikawa et al. | 52/200 |
| 6,158,182 | A | * | 12/2000 | Biebuyck | 52/235 |
| 6,401,410 | B2 | * | 6/2002 | Kenny et al. | 52/235 |
| 6,550,196 | B2 | * | 4/2003 | Braybrook | 52/235 |
| 6,578,340 | B2 | * | 6/2003 | Ishikawa et al. | 52/654.1 |
| 2004/0025454 | A1 | * | 2/2004 | Burgess | 52/204.1 |

FOREIGN PATENT DOCUMENTS

| | | |
|---|---|---|
| DE | 90 11 324 | 11/1990 |
| DE | 199 00 793 | 7/2000 |
| DE | 200 02 142 | 6/2001 |
| EP | 1 138 864 | 10/2001 |

* cited by examiner

SYSTEM PROVIDED WITH PANELS, AND METHOD

TECHNICAL FIELD

The invention provides an entirely novel panel system.

BACKGROUND

Panel systems provided with profiles for holding panels in a desired position are known in various variants. Customary are, for instance, wooden, aluminum or plastic frames, provided with double-glazed panels. An advantage is that these systems themselves are insulating. Through a relatively low strength, these systems are provided with relatively wide and/or thick profiles. A drawback of these system is a, from an aesthetic point of view, undesired 'thick' appearance. Furthermore, wooden profiles require much maintenance, while plastic profiles offer a relatively poor load bearing capacity (and can therefore hold only relatively small panels).

Another known system is provided with non-insulated steel profile parts, for instance in steel curtain walls and Bauhaus architecture. Earlier steel window frames comprise, for instance, single glass panels.

SUMMARY

The present invention contemplates an improvement of the panel system, in particular a very slim and strong system, preferably with a minimal profile width.

To this end, according to the invention, a system is provided which is characterized by the features of claim 1.

The system is provided with panels, for instance glass sheets, and with elements extending along the edges of the panels (for instance for holding the panels) and comprises:

- at least a first element which extends along a first edge of at least one panel, wherein the first element is manufactured from metal, and is of solid design;
- at least a second element which extends along a second edge of the at least one panel; and
- a connection between said first and second element, which connection comprises at least a solid metal, preferably steel, connecting element.

The connection preferably further comprises a thermally insulating part for forming a thermal separation (for instance between the first and second element).

This insulating part can furthermore be configured (in particular as to shape and use of material) for ensuring a wind-tight and watertight system. According to an elaboration, the thermally insulating part can for instance be dimensioned for contributing to the wind-tightness and water-tightness of the system.

The insulating part may be provided with one or more flaps or projections, which, after assembly, can form a wind-tight and watertight seal with other system parts (for instance with a first element mentioned, and/or with a second element). These flaps or projections can for instance be manufactured from plastic (for instance EPDM) and can be fixedly extruded to the insulating part.

According to a particularly advantageous embodiment, the solid metal connecting element is at least dimensioned for substantially absorbing forces in a (first) direction, perpendicular to a panel surface of a panel mentioned, for the purpose of preventing the system from bending under the influence of such forces. These forces can for instance comprise wind pressure. Further, the first element, the second element and insulating part mentioned may be designed for absorbing forces in a first direction, perpendicular to a panel surface of a panel mentioned, but for instance (jointly) to a lesser extent than the connecting element. The first element, second element and insulating part may be designed for absorbing these forces (in the direction perpendicular to the panel surface) after assembly, to a lesser extent (for instance at most 40% of these forces, in particular at most 25% of these forces, or less) than the solid metal connecting element.

It is further advantageous when this solid first element is at least dimensioned for substantially absorbing forces precisely in a (second) direction, parallel to a panel surface of a panel, for the purpose of preventing the system from bending under the influence of such forces. The first elements and the connecting elements can for instance jointly provide a relatively rigid profile construction, with a slim appearance, for stably and durably positioning the panel system after assembly. Further, the connecting element, the second element and insulating part mentioned may be designed for absorbing forces in a second direction mentioned, parallel to the panel surface, but for instance (jointly) to a lesser extent than the first element. The connecting element, second element and insulating part mentioned can for instance be designed for absorbing, after assembly, the forces mentioned (in the direction parallel to the panel surface) to a lesser extent (for instance for at most 40% of these forces, in particular at most 25% of these forces, or less) than the first connecting element.

According to a further elaboration of the invention, a thermally insulating part mentioned is preferably located substantially (for instance for over 50%) in a space located opposite an end face of the panel.

Optionally, the system is also provided with metal or steel distancing means which connect (and hold at a mutual distance) a first element and a connecting element mentioned, while the distancing means are preferably perforated strips.

The invention further provides a method which is characterized by the features of claim 14.

With the method, for instance a system according to the invention can be built, relatively rapidly, with little manpower, and in a particularly simple manner. Here, according to a further elaboration, it is advantageous if one ore more insulating parts are provided between a first element and a connecting element. Optionally, the first element and connecting element are already coupled to each other by distancing means during provision of one or more insulating parts. The distancing means mentioned enable a rapid assembly of the system and can further provide the system with additional safety.

A system according to the invention offers a large number of advantages, and can in particular be of slim design. A maximum width of a (first) element can for instance be 4 cm, preferably 3 cm (measured in a direction parallel to a respective panel).

The invention is based, inter alia, on the inventive concept of the use of a connecting element comprising, for instance, a relatively thick, elongated solid steel part (for instance a solid steel beam) having a thickness which is for instance greater than 1 mm (in particular greater than 2 mm, for instance a thickness in the range of approximately 2-15 mm). The solid part can be of relatively simple design, and have, for instance, an angular, for instance a rectangular cross section. The connecting element can provide the system with a particularly high rigidity, in particular for preventing the system from bending under the influence of wind pressure. Thus, use of sizeable tubular profiles (completely closed in longitudinal direction, or partly open) for providing such rigidity can be prevented.

Furthermore, innovative elaborations of the invention are based on an advantageous location of a thermally insulating part. A highly compact configuration is for instance achieved when the steel connecting element and the thermally insulating part are substantially connected to each other at a location opposite an end face of a respective panel (for instance in an inner space enclosed by end faces of panel parts). Furthermore, the system can be manufactured from relatively little material and few different components, which is favourable in view of the environment and cost price. According to a further elaboration, it is particularly advantageous when the elements and connecting parts (comprising the steel beam and the insulating part) are mutually glued together. Alternatively, parts of the system are connected to each other by means of (preferably watertight) clamping connections and/or dovetail connections.

According to an additionally advantageous elaboration, a combination of clamping and glue connections (or clamping and sealing connections) is used. For instance, the first element can be coupled to a connection mentioned by means of a clamping connection (for instance by clamping a clamping edge of this element into a groove of the connection mentioned), while use is also made of a curable sealant, for instance a glue or sealing edge (for instance in the groove mentioned) for sealing the clamping connection.

Further advantageous embodiments of the invention are described in the subclaims. Presently, the invention will be elucidated on the basis of a number of exemplary embodiments and the drawing. In the drawing:

DESCRIPTION OF DRAWINGS

In this specification, identical or corresponding features are indicated with identical or corresponding reference numerals.

DETAILED DESCRIPTION

Figure 1:
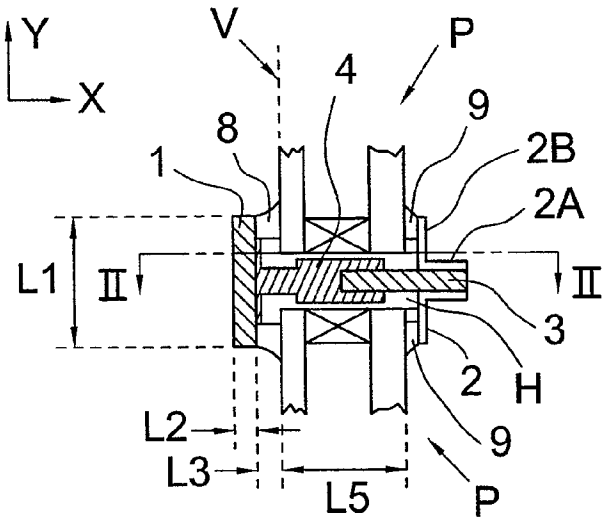
FIG. 1 shows a cross section of a first exemplary embodiment.

FIG. 1, 2, 9 show a first non-limitative exemplary embodiment of the invention, comprising a system provided with one or more panels P, for instance multiple glass sheet panel elements P, and of elongated elements 1, 2 which extend along edges of the panels P (in particular for holding the panels in position, for instance by exerting a clamping force on the panels P).

In the example, each panel P is a thermal insulation panel which is provided with two parallel glass sheets ("double glazing"). In addition, a panel P can for instance comprise only one sheet (for instance of glass) or more than two (for instance three spaced apart parallel glass sheets). In FIG. 1, end faces of neighbouring panels P bound a space H. The system P1, P2, shown in FIG. 1 can be positioned in different manners, for instance vertically, horizontally or at an inclination (with respect to a horizontal plane). The panels P1, P2 can each comprise, for instance, a window or door.

As shown in FIG. 1, the system comprises a first element 1 which extends along a first edge of at least a panel P, in this case along two first edges of two neighbouring panels P. Thus, the first element 1 covers the edges of these two neighbouring panels (viewed in front view).

The first element 1 comprises, for instance, an element 1 extending along outer edges of the panels P. In particular, the first element 1 extends along two longitudinal edges of two panel parts P arranged (at a relatively short distance) with end faces opposite each other, for covering these longitudinal edges.

The first element 1 is of particularly slim design, having a (transversal) width L1, measured in a cross direction (according to arrow Y) with regard to a respective panel edge (i.e., measured in a direction parallel to the panels P), which is less than approximately 5 cm. Preferably, each first element 1 has a maximum width L1 of 4 cm, preferably 3 cm, measured in a direction transverse to the longitudinal edges mentioned.

The present first element 1 has a very simple configuration, and is preferably designed in solid metal, having, for instance, a substantially rectangular cross section. The present first element 1 is not provided with recesses or cavities. Alternatively, the first element 1 can be provided with, for instance, one or more clamping recesses and/or dovetail grooves, designed to be engaged by clamping means and/or dovetail projections of another system part (see FIGS. 10-11).

In this case, an outside of the first element 1 remote from the panels P is parallel to an inside proximal to these panels P. The element 1 preferably extends parallel to (front) surfaces of the double glazed panels P. More preferred, the first element 1 is a solid element, made from steel (in particular stainless steel). The first element 1 can for instance provide the system with a certain rigidity and strength, so that relatively large panels P can durably be held in position. As further shown in the drawing, the first element 1 is located completely outside a panel front plane V defined by the panels P (at least completely in an area located on a side remote from the plane V with respect to the panels P).

A thickness L2 of the first element 1 can for instance be greater than 1 mm, in particular greater than 2 mm, for instance a thickness in the range of approximately 2-15 mm. A ratio between the width L1 and thickness L2 of the first element 1, i.e. L1:L2 can for instance be in the range of 10:1-2:1, in particular 6:1-3:1.

Preferably, first thermally insulating means 8 are provided between the first element 1 and the panels P, for instance sealing means or plastic strips 8. The thermally insulating means (which are preferably manufactured from resilient material, for instance rubber, an elastomer or the like), are preferably also designed for forming a watertight seal between panel outsides and an opposite inside of the first element 1. Preferably, an inside of the first element 1 is at a relatively short distance L3 of opposite panel outsides, for instance a distance L3 which is approximately equal to a thickness L2 of this element 1, or a smaller distance.

Further, after assembly, the system is provided with second elements 2, functioning, for instance, as glazing beads which extend along second edges of the panels P (these second panel edges are parallel to the first edges, and are located at the same panel end faces arranged opposite each other as the first edges).

Figure 2:
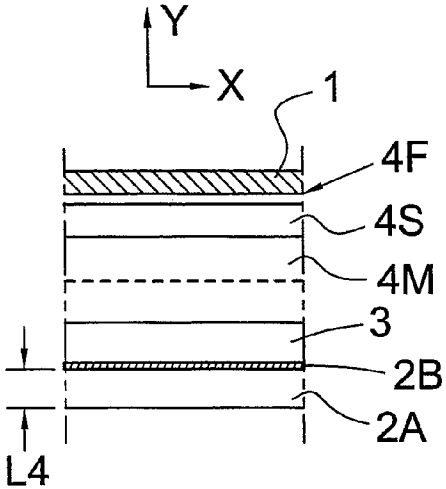
FIG. 2 shows a cross sectional view across line II-II of FIG. 1.

In the elaboration of FIGS. 1, 2, 9, each second element is also of very simple design, and consists in particular of an angle iron diagonal (CHECK), comprising, in particular, a first flange 2*a* and a second flange 2*b*, bent over with respect to the first profile flange. The flanges 2*a*, 2*b* have for instance substantially the same dimensions. In the example, the first and second flange 2*a*, 2*b* of each second element 2 mutually include an angle of 90°. In the example, the second flange 2*b* faces the panel P, by an inside. Preferably, second thermally insulating means 9 are provided between each first element 2 and an opposite panel side, for instance sealing means or plastic strips 9. These second thermally insulating means (which are preferably also manufactured from resilient material, for instance rubber, an elastomer or the like) can also be designed for forming a watertight seal between a panel outside and an opposite inside of the second element 1. A second element can also be designed differently manner, and comprise, for instance, a tube, tubular profile, a U-shaped profile, a glazing bead or the like.

Preferably, each second element 2 is also manufactured from steel (in particular stainless steel). Alternatively, a second element can be manufactured from a metal (for instance aluminum) wood or plastic.

According to a non-limitative example, a width L4 of a first flange part 2*a* (measured in a direction X at right angles with respect to the panels P) can for instance be smaller than 5 cm, and/or for instance be smaller than a thickness L5 of the panels P. In the exemplary embodiment, the flange width L4 is less than half the panel thickness L5. In this manner, a further compactness and slimness of the system can be achieved.

Further, a width L1 of a first element 1 can for instance be approximately equal to or even be less than a panel width L5. Alternatively the width L1 mentioned of a first element 1 may be greater than a panel width L5.

After assembly, a connection 3, 4 is provided between the first and second element 1, 2. Preferably, the connection comprises at least one steel connecting element 3 and is preferably also provided with a thermally insulating part 4 for forming a thermal separation in the system (at least between the first and second element 1, 2).

According to a further elaboration, distancing means 48 can be provided, each holding a first element 1 and respective connecting element 3 at a distance from each other; such distancing means 48 can for instance reach along and/or through the insulating parts 4. The distancing means 48 can each be designed in different manners. In this example, the distancing means 48 has an L-shaped cross section. After assembly, the insulating part (or parts) 4 can for instance at least partly envelop the distancing means 48.

Figure 9B:
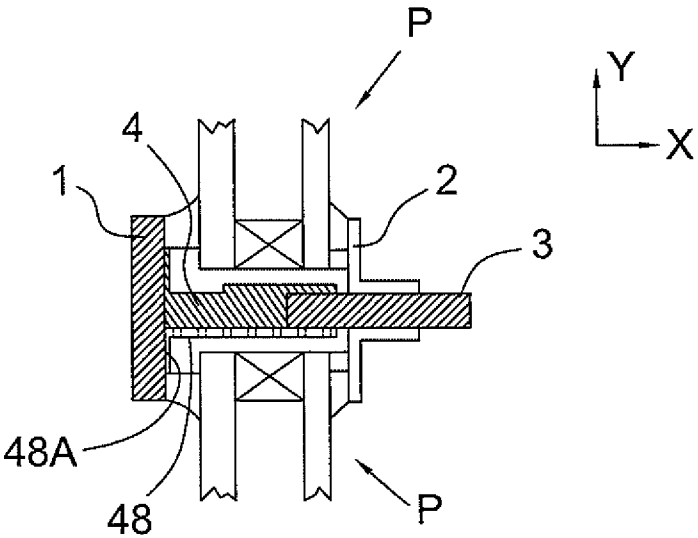
FIGS. 9A-9B show cross sections similar to FIG. 1, wherein also distancing means are shown.
Figure 9A:
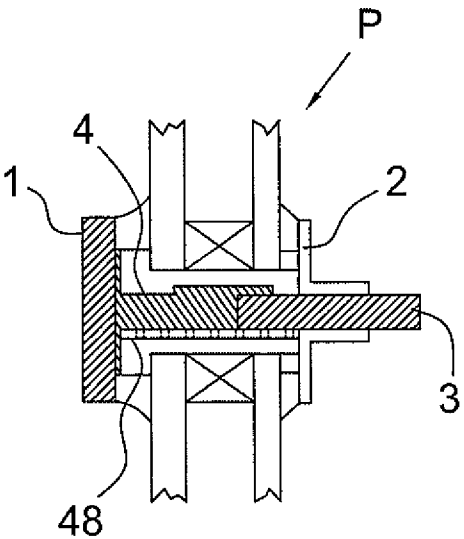
Figure 12:
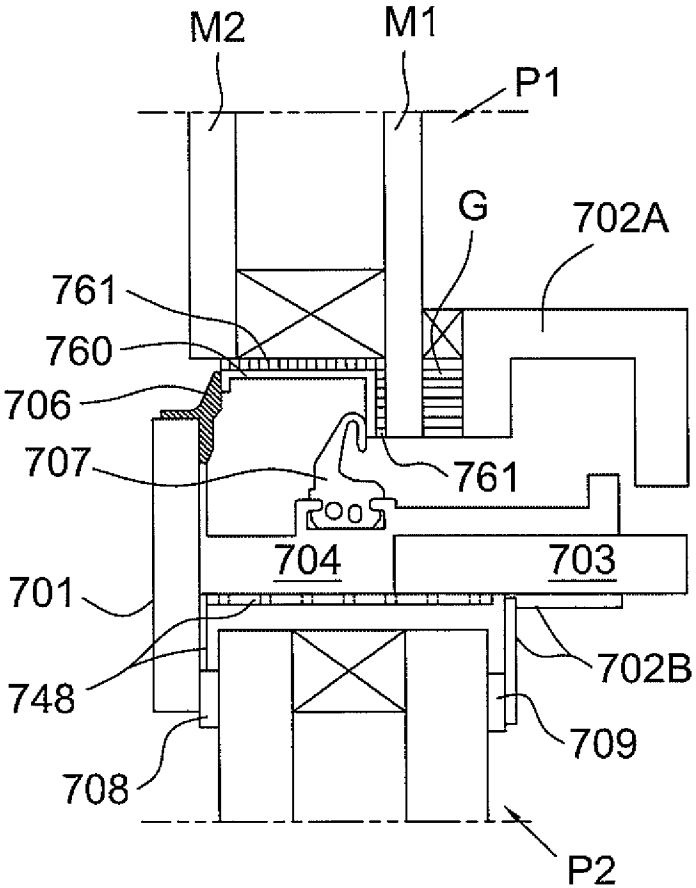
FIG. 12 shows a cross section similar to FIG. 6 of an alternative elaboration.

FIGS. 9A, 9B show cross sections, wherein such a distancing means 48 is represented. According to a further elaboration, each of these distancing means 48 is a perforated metal or steel strip. An advantage of the use of the perforations (in the distancing means) is a higher heat resistance (for preventing a thermal bridge). An example of such distancing means 748 is also represented in FIG. 12.

The strips 48 can for instance be welded to the first elements 1 and connecting elements 3. According to a further elaboration, the strips 48 are of relatively short design, for instance having a width in the range of 1-5 cm measured perpendicularly to the XY plane in the Figures (i.e. the Z-direction in FIG. 2).

These distancing means 48 can be designed in different manners and comprise, for instance, metal distancing means 48, for instance stainless steel strips or the like. These distancing means 48 can for instance be provided at mutual distances of 1 m or more, or smaller distances (in the range of, for instance, 5-10 cm), viewed in a longitudinal direction Z of the system (i.e. at right angles to the XY plane in the Figures). This mutual distance between neighbouring distancing means can be for instance at least 10× a said distancing means width, in particular at least 50×.

FIGS. 9A, 9B show for instance a distancing means 48 attached to a connecting element 3, which is provided with, for instance, a folded-over part 48*a* which (next to the insulating part 4) is attached to the first element 1.

An advantage of the distancing means 48 is that with these, the first elements 1 and connecting elements 3 can be positioned relative to each other, and for instance be solidly connected to each other. This furthermore offers additional safety to the system (for instance prevents profiles P from falling against the system during, for instance, a storm). Furthermore, the distancing means 48 can enable the insulating parts 4 to be provided during assembly after other manufacturing steps (for instance optional coating of elements 1, 3), particular gluing steps and the like.

The steel connecting element 3 itself is also of a particularly simple design. In the first example, the steel connecting element 3 consists of an elongated solid steel connecting element or carrier 3 (for instance a supporting beam), preferably with a thickness (measured in a direction Y parallel to front face V) which is greater than 1 mm, in particular greater than 2 mm, for instance a thickness in the range of approximately 2-15 mm. The present solid connecting element 3 has no recesses or passages. As follows from the drawing, the connecting element 3 extends at right angles to the first element 1, and reaches between the panels P (i.e., between the end faces thereof).

A width of the connecting element 3 (measured in a direction X at right angles with respect to the panels) is preferably at least approximately equal to a thickness L2 of the first system element 1. In the exemplary embodiment, the connecting element has a rectangular cross section; in this example, side surfaces of the connecting element 3 facing away from each other are parallel to each other. The connecting element-width (measured in the X direction) is for instance approximately equal to or even less than a panel width L5 mentioned.

In this case, the steel connecting element 3 reaches for at least 50% (for instance volume %, mass % or both, as is the case in this example) opposite (i.e. along) an end face of a panel P, in particular from a second element 2 in the direction of a first element 1. The connecting element 3 is therefore substantially (at least half) in the space H bounded by the end parts of the panels P.

The connecting element does not touch the panels P, and is indirectly connected to the first element 1 by means of the thermal intermediate piece 4. Side surfaces of the connecting element 3 are at a distance from opposite end faces of the panels P. The second elements 2 are indeed directly connected (integrally by the first flanges 2*a*) to (side surfaces of) the connecting element 3. The connection between the connecting element 3 and the insulating part 4 is preferably completely in the space H (see FIG. 1).

As follows from the Figures, the thermally insulating part 4 is preferably located substantially (for instance for over 50%, for instance volume %, mass % or both, as is the case in this example) in the system inner space H.

The insulating part 4 is manufactured from, for instance, plastic, rubber, an elastomer or another suitable, thermally insulating material. The insulating part 4 is designed for substantially preventing heat transfer between the first and second element 1 and carrier 3. The insulating part 4 can further provide a wind-tight and watertight seal. Preferably, the insulating part 4 does not touch the panels P; in the example, relatively narrow slits are present between the insulating part 4 and panel end faces. Each insulating part 4 can be manufactured in a particularly advantageous manner simply by means of a plastic extrusion process.

More particularly, the thermally insulating part 4 is provided with a first connecting part 4M, to which the carrier 3 is connected, preferably utilizing a suitable (direct, mutual) glue connection. In particular, the first connecting part 4M is provided with a recess U in which a part of the carrier 3 is received (see also the further elaborations according to FIGS. 6-8).

Figure 11:
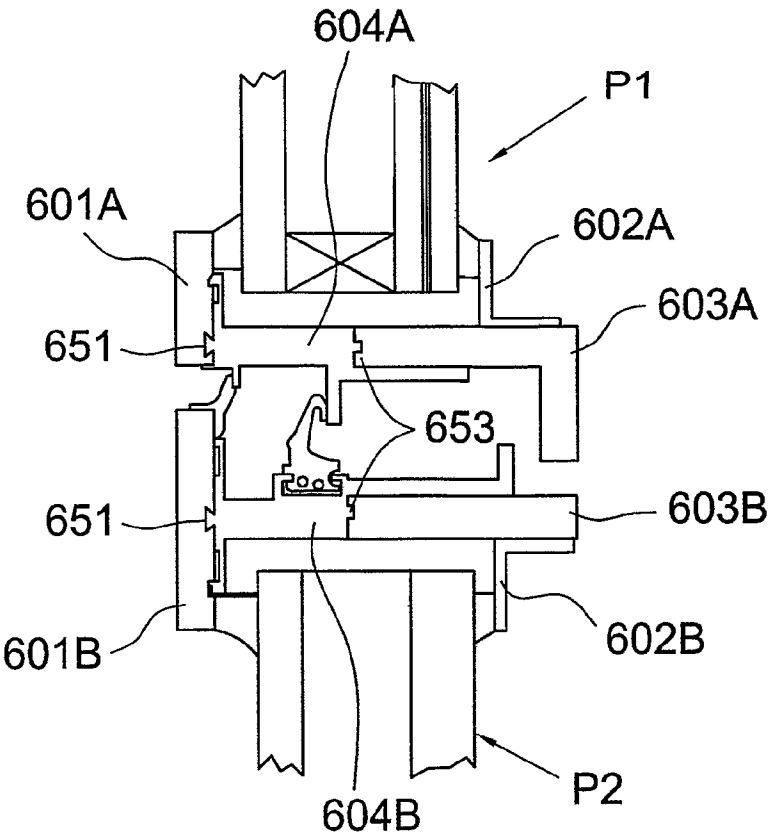
FIG. 11 shows a cross section similar to FIG. 6 of a further elaboration with dovetail joints.
Figure 10:
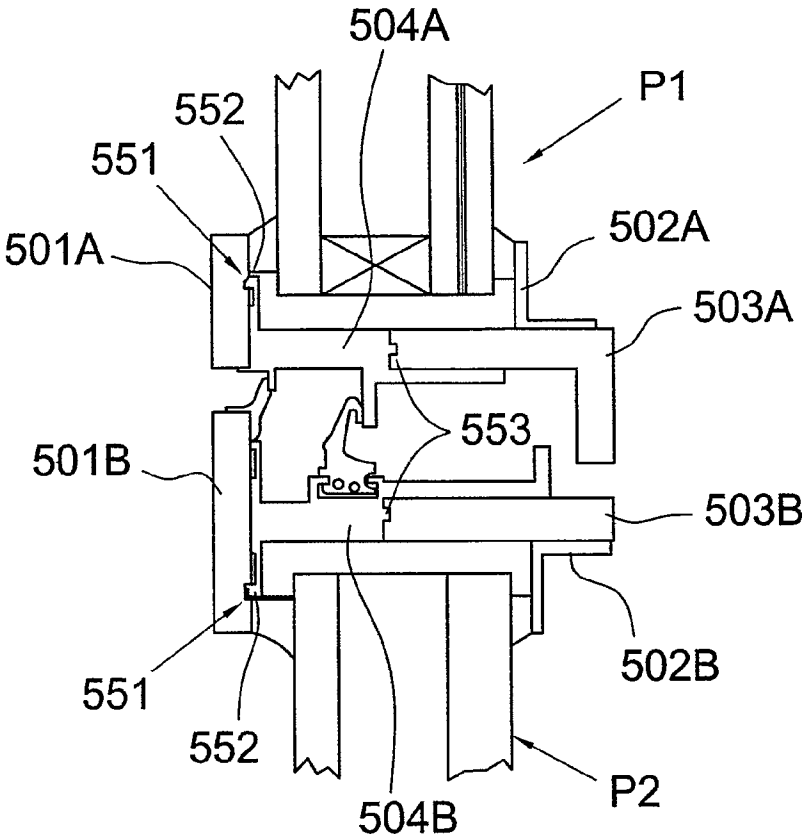
FIG. 10 shows a cross section similar to FIG. 6 of a further elaboration with clamping connections.

Alternatively, a (preferably watertight) clamping connection and or dovetail coupling can be provided for coupling the carrier 3 and the insulating part 4 to each other; such a connection is preferably a part of the carrier 3 and the insulating part 4. FIGS. 10 and 11 show examples of such clamping couplings and dovetail connections, respectively.

More particularly, the thermally insulating part 4 is provided with a second connecting part 4S, to which the first element 1 is connected, preferably utilizing a suitable glue connection and/or clamping connection. In particular, the second connecting part 4S is provided with a front flap ("glue flap") 4F in which the first element 1 is fixed (glued). In this example, this front flap 4F extends in sideway directions with respect to a middle surface of the insulating part 4 (parallel to the rear side of the first element 1) and between the first thermally insulating means 8 (preferably the first thermally insulating means 8 and front flap F link up with each other). The second connecting part 4S is for instance of reduced design with respect to the first connecting part 4M (viewed in cross section). After assembly, a glue flap 4F of the insulating part 4 forms a wind-tight and watertight seal with the first element 1.

Alternatively (not represented) the insulating part and first element 1 can be coupled to each other by means of, for instance, a clamping connection (wherein for instance a front edge of the insulating part is clamped into a groove of the first element). In that case, it is additionally advantageous when the groove is provided with a sealing means (for instance sealant) for providing a watertight connection.

Alternatively, a clamping and/or dovetail connection can be provided (see FIG. 10-11) for connecting the first element 1 and the thermally insulating part 4 to each other.

The thermally insulating part 4 itself can be designed to be somewhat elastic, for instance resilient, this is, however, not necessary. The insulating part 4 can for instance be a rigid part, for instance a fiber reinforced part 4 (in particular of a part manufactured from insulating material, a fiber reinforced plastic, a composite or the like).

According to a further elaboration, sealing means can be provided between, on the one side, the thermally insulating part 4 and the first element 1 and/or, on the other side, the connecting element 3. According to a further elaboration (not represented), the thermally insulating part 4 can be provided with one or more grooves for receiving sealing means (for instance sealants) for the purpose of a watertight connection to the first element 1 and/or the connecting element 3.

Assembling the system shown in FIGS. 1-2 comprises for instance a relatively simple method, comprising the steps of (which can be performed in varying orders)

- providing at least a first element 1, at least a second element 2 and at least a connecting element 3;
- providing at least a panel P;
- providing along a first longitudinal edge of the panel P the first element 1 (for instance by bringing the panel in a suitable position with respect to the first element 1);
- directly or indirectly connecting to the first element 1 *a* connecting element 3; and
- providing along a second longitudinal edge of the panel P the second element 2, which second element is connected to the connecting element.

Different first elements 1 can for instance be welded to each other for forming a frame, which frame, after assembly, extends along different panel edges.

A first element 1 mentioned and connecting element 3 can for instance first be connected (directly or indirectly) to each other. Then, for instance, a second element 2 can be connected to the connecting element 3 (for instance after the panel is positioned along the first element 1).

A first element 1 and connecting element 3 can for instance first be connected (directly or indirectly) to each other utilizing an insulating part 4.

Additionally, it is highly advantageous when a first element 1 and connecting element 3 are (preferably first) connected to each other, utilizing, for instance, a number of (preferably metal or steel) distancing means 48 (see FIG. 9A, 9B) and in particular utilizing durable welding connections. Then, an insulating part 4 can be provided between the coupled together assembly of first element 1 and connecting element 3 (see further).

Optionally, sealing means are provided between, on the one side, the thermally insulating part 4 and the first element 1 and/or, on the other side, the connecting element 3 (for instance in grooves provided thereto in the insulating part 4), for providing additional watertight connection.

A connection 3, 4 is for instance formed between the first and second element 1, 2, utilizing a solid (steel) connecting element 3 and the thermally insulating part 4. Preferably, also, the first and second insulating means 8, 9 are provided. Preferably, the system is assembled such that, via the first and second insulating means 8, 9, the first and second elements 1, 2 exert clamping forces directed towards each other, for the purpose of holding the system (1, 2, 3, 4, P) together.

As mentioned, the use of glue connections is preferred, but also another type of connection, for instance watertight clamping connections and/or dovetail connections (see FIGS. 10 and 11) can be utilized, or a combination. A glue connection can be utilized for connecting a first element 1 (by a respective flat rear side) to a connecting face of a thermally insulating part 4, which connecting face is preferably a flat surface. In the example, the connecting face comprises a front side of the front flap 4F of the insulator 4. As mentioned, is it additionally advantageous (in an elaboration not shown) to couple a first element by means of a clamping connection (for instance groove/flange connection) to a thermally insulating part, preferably utilizing a curable sealing means.

As shown in FIG. 9B, the optional distancing means 48 can for instance engage the first element 1 next to an insulator (in this case; next to the insulator front flap 4F), and in this example via the folded-over part 48*a* of the distancing means.

In other words: the (preferably perforated, preferably metal or steel) distancing means 48 and the insulating part 4 can engage the first element 1 at mutually different locations. In this case, distancing means 48 and the insulating part 4 can be connected to the same side (inside) of the first element 1.

As also shown in FIGS. 9A, 9B, the distancing means 48 and the insulating part 4 can engage the connecting element 3 at mutually different locations (for instance at sides of this element 3 remote from each other, as in FIG. 9).

The steel connecting element 3 is preferably provided with a number of flat connecting surfaces, wherein the connecting element 3 is glued by at least one connecting face to a flat connecting surface of a thermally insulating part 4.

Also, glue connections can be utilized for connecting the second elements 2 each by a respective connecting surface (i.e. a flange outside) to connecting faces of the steel connecting element 3. The glue connections provide a durable system, can be provided in a relatively simple manner (for instance without utilizing screw means or snap systems) and take up particularly little space, which is beneficial to the desired slimness of the system.

A system assembling method can for instance comprise the following steps 1-6:

1) manufacture of profile assemblies, by connecting to each other first elements 1 and connecting elements 3 via the distancing means 48 (for instance perforated metal or steel strips 48, for instance provided with folded over connecting parts 48*a*), preferably utilizing welding connections;

2) optionally: providing the profile assemblies 1, 3, 48 obtained in step 1 with desired lengths (for instance by means of sawing);

3) forming a frame by coupling profiles assemblies 1, 3, 48 obtained from step 1) and/or 2) (utilizing, for instance, corner elements and/or T-elements); the frame to be formed may then be provided by openings defined by the elements 1, 3 for receiving panels P);

4) a frame 1, 3, 48 obtained from step 3) is optionally provided with a coating (for instance by means of powder coating);

5) the frame 1, 3, 48 obtained from step 3) or 4) is provided with insulating parts 4, for instance by clamping and/or gluing these parts between the first elements 1 and connecting elements.

6) the assembly 1, 3, 4, 48 obtained from step 5) is brought to a desired end location (for instance the building site) and assembled at a desired position and provided with the panels P. Then, the second elements 2 can be provided (for instance by gluing these elements 2 to connecting elements 3, and/or clamping these elements 2, 3 with clamping means) for holding the panels.

One or more (for instance all) steps 1-5 can for instance be carried out at a different location than a desired end location of the system.

Figure 3:
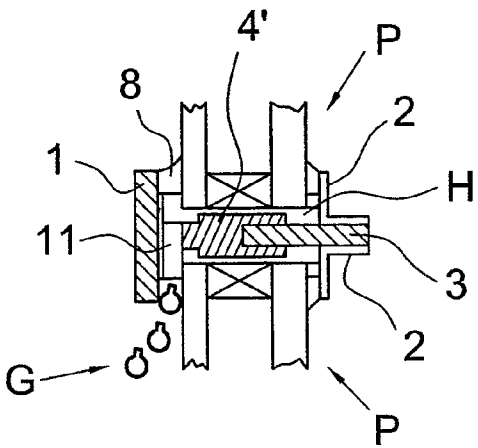
FIG. 3 shows a cross section of a second exemplary embodiment.
Figure 4B:
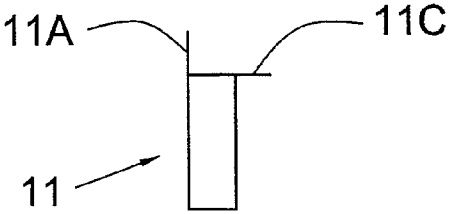
FIG. 4B shows a side view of the element shown in FIG. 4A.
Figure 4A:
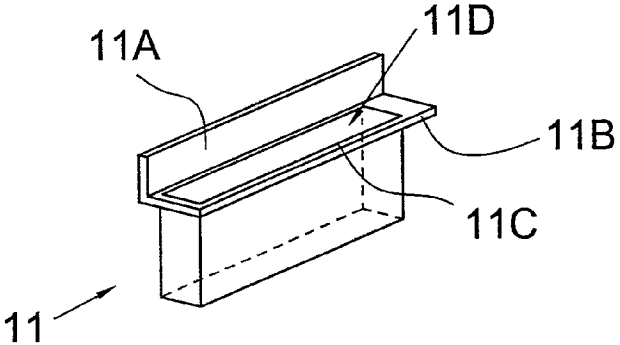
FIG. 4A shows a perspective drawing of a draining element of the system shown in FIG. 3.
Figure 4C:
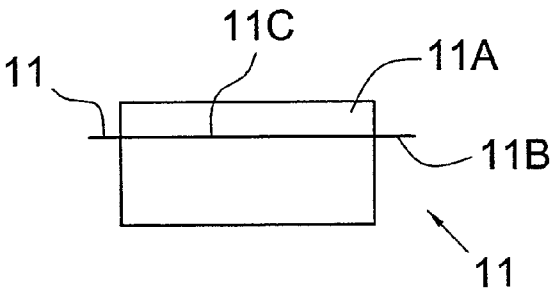
FIG. 4C shows a front view of the element shown in FIG. 4A.

FIGS. 3-4 show an alternative embodiment which is distinguished from the system shown in FIGS. 1-2, 9 in that a draining element 11 is provided (for instance for draining rain water and/or condensation water). The draining element is provided between a thermally insulating part 4' and a first element 1 for the purpose of draining water G from an inner space defined by the system to surroundings. The present draining element (see FIGS. 4A-4C) is of block-shaped design (with rectangular cross sections) and is provided with a passage 11D for the purpose of allowing water to pass. In this case the insulating part 4' is not provided with the above mentioned sideways glue flaps. According to a further elaboration, walls of the draining element 1 which enclose the passage 11D, are of relatively thin design, for instance with a thickness less than 2 mm, so that the passage is relatively wide. The system shown in FIGS. 3-4 can further for instance be provided with distancing means 48 (not represented in FIGS. 3-4).

The system can for instance comprise a row of such draining elements provided side by side. The draining element 11 can for instance replace one of the above mentioned first thermally insulating means 8.

Also, glue connections can be utilized for connecting a first element 1 by a respective connecting surface to first connecting faces of a draining element 11, wherein a second connecting face of the draining element 11 is glued to a connecting face of a thermally insulating part 4, with the connecting faces each preferably being flat surfaces.

The present draining element 11 comprises, for instance, a number of sealing flaps 11*a*, 11*b* for linking up with other system parts 1, 4'. A vertical sealing flap 11A can link up with a rear side of the first system element 1, and for instance be glued thereon. Sideways extending horizontal flaps 11B of neighbouring draining elements 11 can for instance mutually overlap (and be connected to each other, by means of, for instance, glue connections). A horizontal rear flap 11C of draining element 11 can for instance link up with a glue surface of the insulating part 4' (and is preferably glued thereon by a glue surface).

The draining part 11 can be manufactured from different materials, for instance somewhat elastic material, for instance resilient material, or, conversely, of rigid material, for instance a fiber reinforced part 11 (in particular of a non-reinforced plastic or, conversely, a fiber reinforced plastic, a composite or the like).

The system shown in FIGS. 3-4 has the abovementioned advantages of the first exemplary embodiment, and furthermore provides for good moisture processing.

In the elaborations according to FIGS. 1-4, the panels P are fixedly (i.e. immovably) arranged with respect to each other. FIGS. 5-8 show examples of a system with movable panels P1, P2.

Figure 5:
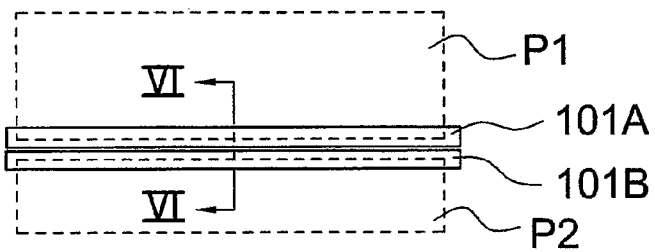
FIG. 5 shows a front view of a part of the third exemplary embodiment.
Figure 6:
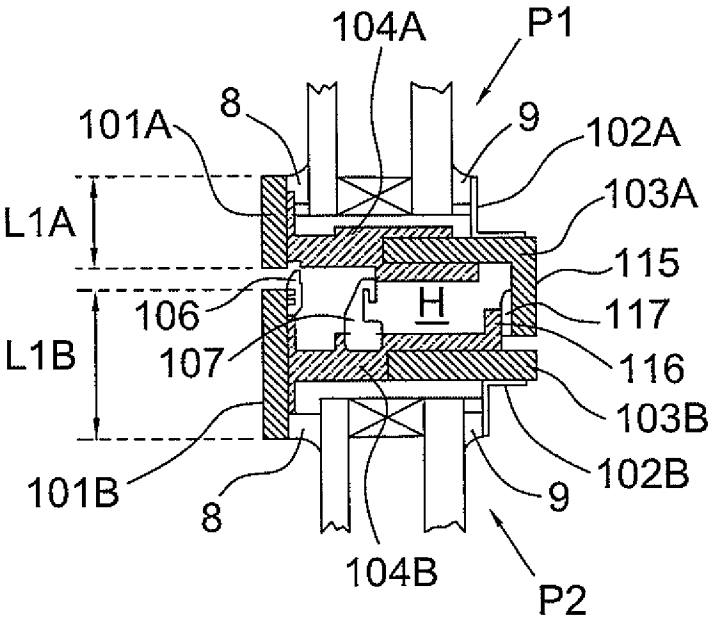
FIG. 6 shows a cross section across line VI-VI of FIG. 5.

FIG. 5 shows a part of a system comprising a first and a second panel P1, P2, which are relatively movable. One of (or both) panels P1, P2 is/are for instance pivotal about a respective pivot. FIGS. 5-6 show a closed panel position, with the panels P1, P2 moved together by end faces, for sealing off, for instance, a respective opening; with this closed position, again, end panel faces bound an intermediate space H.

The system comprises the first and second elements 1, 2 for at least partly covering the panels ends P1, P2 (viewed from a surrounding). In this case, an end face of each panel P1, P2 is provided with a respective first element 101*a*, 101*b*, a respective second element 102*a*, 102*b*, a respective steel connecting element 103*a*, 103*b* and a respective thermally insulating part 104*a*, 104*b*. FIG. 12 shows an alternative embodiment, in which a movable (for instance pivotal) panel P1 is not provided with a first element, and not with a connecting element; in this case, the panel P1 is glued to a second element 702A.

Preferably, first thermally insulating means 8 are provided between the first element 1 and the panels P, for instance sealing means or plastic strips 8. The thermally insulating means (which are preferably manufactured from resilient material, for instance rubber, an elastomer or the like) are preferably also designed for forming a watertight seal between panel outsides and an opposite inside of the first element 1. Preferably, an inside of the first element 1 is at a relatively short distance L3 from the opposite panel outsides, for instance a distance L3 which is approximately equal to a thickness L2 of this element 1 or a smaller distance.

The system is further provided with second elements 2, functioning, for instance, as glazing beads, which extend along second edges of the panels P (these second panel edges are parallel to the first edges and are located at the same panel end faces disposed opposite each other as the first edges). In this example too, first and second sealing means (with thermally insulating function) 8, 9 are provided between the first and second elements 101, 102 and the panels P, for instance sealing means or plastic strips 8, 9.

In this case, each first element 101 preferably has a maximum width L1*a*, L1*b* of 4 cm, in particular 3 cm. As shown in the Figures, the width L1A of the one first element 101*a* can for instance be smaller than the width L1B of the other first element 101B, for instance at least 2× smaller. According to a highly advantageous elaboration, the total length (L1*a*+L1*b*) of both first elements 101*a*, 101*b* is at most 8 cm, in particular at most approximately 5 cm.

Further, in the closed panel position, edge faces facing each other of the first elements 101*a*, 101*b* of the two panels P1, P1 are preferably at a short distance from each other, for instance a distance of less than 1 cm, in particular a distance of less than 3 mm.

Figure 8B:
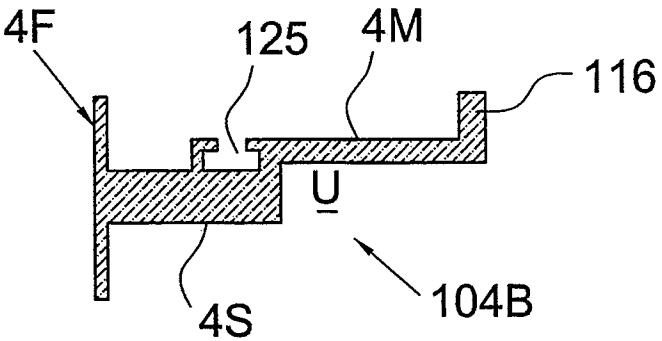
FIGS. 8A-8D show cross sections of insulating parts of the systems shown in FIGS. 6-7.
Figure 8D:
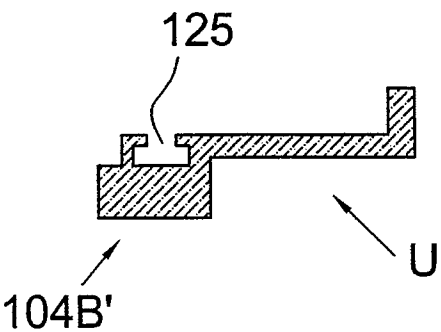
Figure 8A:
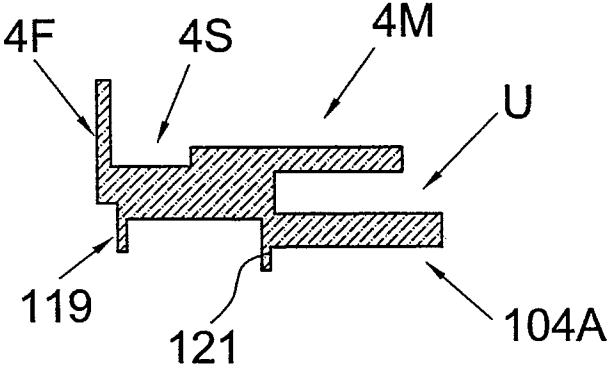
Figure 8C:
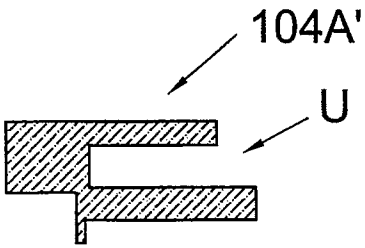

Connections between a first element 101*a*, 101*b* and thermally insulating part 104*a*, 104*b*, respectively, are again preferably (wind-tight and watertight) glue connections. As shown by FIGS. 8A, 8B, to this end, the thermally insulating parts 104*a*, 104*b* can be provided with crosscut glue flaps 4F extending sideways (which, after assembly, form wind-tight and watertight connections with respective first elements 101). Connections between the thermally insulation parts 104*a*, 104*b* and respective steel connecting elements 103*a*, 103*b* are again also preferably glue connections (and preferably, after assembly, wind-tight and watertight connections). To this end, the thermally insulating parts 104*a*, 104*b* can be provided with, for instance, recesses U, in which parts of the steel carriers 103 can be glued. In this example, steel connecting elements 103*a*, 103*b* and respective second elements 102*a*, 102*b* are also glued to each other.

In this case, one steel carrier 103A (of the first panel P1) is a solid, L-shaped steel section, viewed in cross section. From this profile, the leg 115 extending sideways (with respect to the connecting element 103A) can for instance serve as first stop, for cooperating with a second stop of the opposite panel P2 for the purpose of determining a closed position of the panels. In this case, a folded-over edge 116 of the insulating part 104B of the second panel P2 comprises this second stop. As shown in the Figures, the first or second stop 115, 116 can for instance be provided with an impact absorber or bumper strip 117 (for instance of resilient material).

The other carrier 103B (of the second panel) has, for instance, the same configuration as the carrier 3 of the system shown in FIGS. 1-2.

Further, in the closed panel position, the edge surfaces of the steel carrier sections 103*a*, 103*b* facing each other, belonging to the two panels P1, P2, are preferably located at a short distance from each other, for instance at a distance of less than 1 cm, in particular a distance of less than 3 mm.

The parts 101*b*, 102*b*, 103*b*, 104*b* provided on the second panel P2 are provided with sideways extending sealing strips 106, 107 which link up with the opposite parts 101*a*, 102*a*, 103*a*, 104*a*, of the first panel P1 in a closed position of the two panels P, preferably at a position between end faces of the panels P.

In this example, the insulating part 104 and the second element 102*b* belonging to the second panel P2 are provided (along a side edge of a flap 4F) with a first sealing strip 106 reaching sideways, which strip 106 links up with a first sealing edge (in particular a thin sealing flap) 119 of the other thermally insulating part 104*a*, with the two panels P in closed position.

Furthermore, the insulating part 104*b* belonging to the second panel P2 is provided with a second sealing strip 107 reaching sideways, which links up with a second sealing edge (in particular a thin sealing flap) 121 of the other thermally insulating part 104*a* with the two panels P in a closed position. As shown in FIG. 8B, the insulating part 104 can for instance be provided with a groove or the like bounded by projections, for holding the second sealing strip 107.

In this case too, each insulating part 104 can be manufactured in a particularly advantageous manner by means of a plastic extrusion process. Here, it is further advantageous if one or more of the sealing strips 106, 107 is/are extruded simultaneously with the respective insulating part 104*b* so that these parts are manufactured simultaneously, in the same process step.

The sealing edges (i.e. sealing flaps) 119, 121 of one insulating part 104*a* extend for instance sideways (over a relatively short distance, for instance in the range of 1-5 mm) in a direction away from the first panel P1.

The sealing flaps 119, 121 which provide these sealing edges may have been manufactured in one piece with the insulating part 104*a*, and be of relatively thin design (for instance with a maximum thickness of 1 mm).

Figure 7:
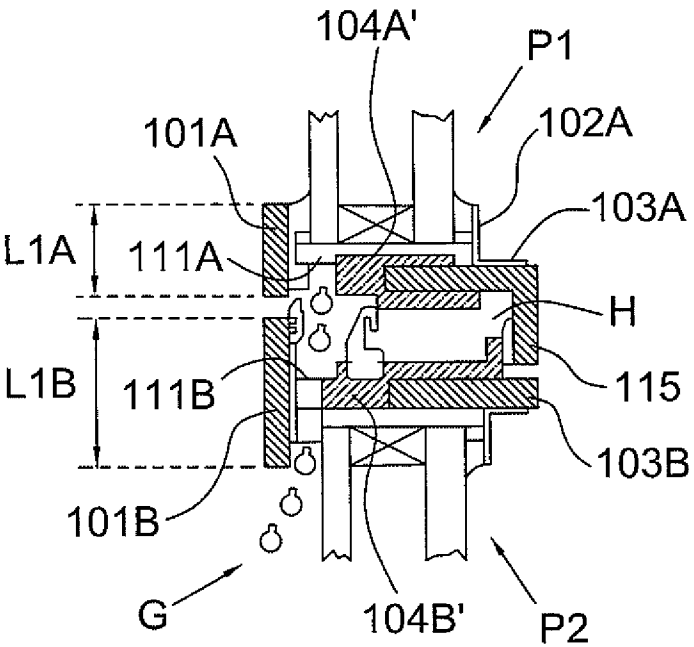
FIG. 7 shows a similar cross section to FIG. 6 of an alternative elaboration.

FIG. 7 shows an alternative elaboration of the system represented in FIG. 6, wherein draining elements 111*a*, 111*b* are provided (for instance for draining rain water and/or condensation water G). As in FIG. 3, the draining elements 111*a*, 111*b* are each provided between a respective thermally insulating part 104*a*', 104*b*' and a respective first element 101*a*, 101*b*. The draining elements 111*a*, 111*b*, can be configured as the element shown in FIGS. 4A-4C, or in a similar manner, for instance block-shaped, with respective passage for the purpose of allowing water to pass, and for instance with a number of sealing flaps for linking up with other system parts.

FIG. 10 shows a further elaboration, which is distinguished from elaborations represented in FIGS. 1-9 in that clamping connections 551, 552, 553 are provided for coupling system parts 501, 503, 504 together. The clamping connections 551, 552, 553 can for instance be utilized in combination with (i.e. can each be provided with) glue and/or sealant, for reinforcing the respective clamping connection and render it extra watertight. Second elements 502A, 502B are connected to the carrier elements 603A, 603B by means of, for instance, glue connections (or by non represented damping means).

In this example, each first element 501A, 501B is provided with clamping means 551 (for instance with a clamping recess), designed to be engaged by engaging means 552 of a respective insulating part 504A, 504B. Each clamping connection can comprise a first clamping part (for instance groove, or projection 551) of the first element 501, and a second clamping part (for instance projection, or groove, 552, respectively) of the insulating part 504 to be clampingly coupled to the first clamping part. The clamping connections 551, 552 are preferably manufactured from one piece with the respective first elements 501 and insulating parts 504.

In this example, also, clamping connections 553 are provided for coupling each carrier 503A, 503B and respective insulating part 504A, 504B to each other; such clamping connections are also preferably integrally part of the respective carriers 503 and insulating parts 504.

The combination shown in FIG. 10 provides for a particularly good durability, water-tightness and ease of assembly.

FIG. 11 shows a further elaboration, which is distinguished from the elaboration represented in FIG. 10 in that the clamping connections between the firsts elements 601A, 601B, insulating parts 604A, 604B and connecting elements 603A, 603B comprise dovetail connections 651, 653. Optionally, the dovetail connections 651, 653 (each comprising—viewed in cross section—a dovetail shaped projection of one part, which projection—viewed in cross section—can be introduced into the dovetail shaped groove of the other part) are each provided with glue and/or sealant. In this manner too, a particularly strong and watertight coupling between the system parts 601, 603, 604 can be achieved.

FIG. 12 shows a further elaboration which is distinguished from the elaboration represented in FIG. 6 in that a movable (in particular pivotal) panel P1 is connected, by means of a glue connection G, to a second element (for instance a steel inner profile) 702A. A cross-cut part of this panel P1 can for instance be provided with an edge profile 760, connected to each other by, for instance, a glue connection 761. In this case, the edge profile 760 has a substantially L-shaped cross section, wherein both legs of the profile 760 are connected by respective glue connections 761 to opposite surfaces of the panel P1. Here, the first panel P1 comprises panel plates M1, M2, of which one first plate M1 reaches further in the direction of the opposite panel P2 than the second plate M2. A projecting part of the first plate M1 is located between, on the one side, the second element 702A and, on the other side, a leg of the edge profile 760.

FIG. 12 further shows use of a first element 701, second element 702B, respectively, a respective connecting part 703, an insulating part 704 and an optional distancing means 748, sealants 708, 709 and respective stationary disposed panel P2. An optional sealing strip 707 reaches sideways from the insulating part 704 for—in this case—linking up with the edge profile 760, with the panel P1 in the closed position shown. Another sealing strip 706 can seal off a slit between the first element 701 and an end of the edge profile 760 (in closed panel position). This elaboration further emphasizes the slimness of the assembly, and saves material.

The system provided by the present invention provides a particularly good thermal and acoustic insulation, is properly watertight, is particularly durable and offers a very slim appearance. The system is highly suitable for use in an outer wall (of a building). The system can also serve as replacement for an old-fashioned (poorly insulating) steel frame system.

It will be clear to the skilled person that the invention is not limited to the exemplary embodiments described. Various modifications are possible within the framework of the invention as set forth in the following claims. In this specification, the term "one" can mean for instance at least one, for instance one or more. In this specification, the term "solid element" means for instance that this element is not a tubular section and does for instance not enclose a space in itself. In particular, the solid element in itself has no inside surfaces extending opposite to each other (but for instance only a continuous outside surface).

For instance, a connection between certain parts of the system may comprise a glue connection, or a different connection, for instance a mechanical connection, a snap connection and/or a clamping connection. A clamping connection can for instance form integral part of the respective parts to be clamped together, by being manufactured in one piece with those parts, and is preferably provided with a sealing means (for instance glue or sealant) (see FIGS. 10 and 11).

The invention claimed is:

1. A system provided with panels and with elements which extend along edges of the panels, the system comprising:

at least two neighbouring panels, each panel being a thermal insulation panel that is provided with two parallel glass sheets, wherein opposite end faces of the neighbouring panels define a space between the opposite end faces;

a first element extending along two longitudinal outer edges of the two neighbouring panels, for covering these longitudinal outer edges, wherein the first element is an elongated beam manufactured from metal, is of solid design and has a thickness of at least 2 mm;

second elements extending along second edges of the two neighbouring panels, the second panel edges being parallel to the first edges, and being located at the same panel end faces arranged opposite each other as the first edges, and a connection between said first element and second elements, the connection comprising:

a solid metal connecting element, wherein the solid connecting element is a solid elongated steel supporting beam having a thickness of more than 2 mm, which extends at right angles with respect to the panels, and the entire connecting element is solid; and a thermally insulating part that physically separates the first element from the solid metal connecting element such that the first element does not touch the solid metal connecting element, wherein a said first element extends along two longitudinal edges of two panel parts arranged side by side, for covering these longitudinal edges, and has a maximum width of 4 cm, measured in a transverse direction with respect to said longitudinal edges.

2. The system according to claim 1, wherein the said first element has a maximum width of 3 cm, measured in a transverse direction with respect to said longitudinal edges.

3. The system according to claim 1, wherein said first element, second element and insulating part are designed for absorbing said forces, after assembly, to a lesser extent than the solid metal connecting element.

4. The system according to claim 1, wherein said solid first element is at least dimensioned for substantially absorbing forces in a direction parallel to a panel surface of a said panel, for the purpose of preventing the system from bending under the influence of such forces.

5. The system according to claim 1, wherein said first element is of slim design, with a width, measured in a transverse direction with respect to a respective panel edge, which is smaller than approximately 5 cm.

6. The system according to claim 1, provided with at least one draining element which is arranged between a said thermally insulating part and a said first element for the purpose of draining water from an inner space defined by the system to a surrounding.

7. The system according to claim 6, wherein the draining element is provided with a passage for the purpose of allowing water to pass, and is preferably provided with one or more sealing flaps for linking up with other system parts.

8. The system according to claim 1, wherein the solid connecting element is made of steel and does not have recesses or passages.

9. The system according to claim 1, wherein a connection between the connecting element and the insulating part is located completely between the panels in the space between the opposite end faces of the panels.

10. The system according to claim 1, wherein the connecting element has a thickness in the range of approximately 2-15 mm.

11. The system according to claim 1, wherein the first element has a thickness in the range of approximately 2-15 mm.

12. The system according to claim 11, wherein the first element has a substantially rectangular cross section.

13. The system according to claim 1, wherein the connecting element is made of steel.

14. The system according to claim 1, wherein the outer side of the panels is the 'weather' side of the panels which face away from a respective building.

15. The system according to claim 1, wherein the first element and the connection element are made of different materials.

16. The system according to claim 1, wherein a longitudinal center plane of the solid elongated steel supporting beams extends in parallel with the opposite end faces of the two panels.

17. The system according to claim 1, wherein the solid steel supporting beam has a rectangular cross-section.

18. The system of claim 1, wherein at least 50 volume percent of the thermally insulating part is located between the panels in the space between the opposite end faces of the panels.

19. The system of claim 1, wherein the thermally insulating part forms a closed thermal separation between the first and second elements.

20. A method for assembling a panel profile system according to claim 1, comprising performing in a suitable order, at least:

providing at least a said first element, a second element and a connecting element;

directly or indirectly connecting to the first element a said connecting element;

providing at least one panel;

providing along a first longitudinal edge of the panel the first element; and providing along a second longitudinal edge of the panel the second element wherein the second element is connected to the connecting element.

21. The method according to claim 20, wherein different first elements are welded to each other for forming a frame, which, after assembly, extends along different panel edges.

22. The method according to claim 21, wherein at least one or more glue connections are used for connecting different parts of the system to each other.

23. The method according to claim 22, wherein at least one or more watertight clamping connections are utilized for connecting different parts of the system to each other.

24. The method according to claim 23, wherein at least one or more dovetail connections are used for coupling different parts of the system to each other.

25. The method according to claim 24, wherein a said first element and a said connecting element are first connected to each other by means of a number of distancing means, wherein later, one or more said second elements are provided on the connecting element.

26. The method according to claim 25, wherein one or more insulating parts are provided between a said first element and a said connecting element.

27. The method according to claim 25, wherein the distancing means are perforated metal strips.

* * * * *